US007119298B2

(12) United States Patent
Yoshiyama et al.

(10) Patent No.: US 7,119,298 B2
(45) Date of Patent: Oct. 10, 2006

(54) METHOD FOR ELECTROSTATICALLY SEPARATING PARTICLES, APPARATUS FOR ELECTROSTATICALLY SEPARATING PARTICLES, AND PROCESSING SYSTEM

(75) Inventors: Eiji Yoshiyama, Hyogo (JP); Yasunori Shibata, Hyogo (JP); Tetsuhiro Kinoshita, Tokyo (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 172 days.

(21) Appl. No.: 10/344,683

(22) PCT Filed: Mar. 26, 2002

(86) PCT No.: PCT/JP02/02878

§ 371 (c)(1),
(2), (4) Date: Jun. 2, 2003

(87) PCT Pub. No.: WO02/076620

PCT Pub. Date: Oct. 3, 2002

(65) Prior Publication Data

US 2004/0035758 A1 Feb. 26, 2004

(30) Foreign Application Priority Data

Mar. 27, 2001 (JP) ..... 2001-89438

(51) Int. Cl.
*B03C 7/01* (2006.01)

(52) U.S. Cl. ..... 209/127.1; 209/127.2; 209/127.3; 209/128; 209/131; 209/12.2; 209/132; 209/133; 209/138

(58) Field of Classification Search ..... 209/127.1–131, 209/12.2
See application file for complete search history.

(56) References Cited

U.S. PATENT DOCUMENTS 2,848,108 A * 8/1958 Brastad et al. ..... 209/127.3
3,042,814 A * 7/1962 Campbell, Jr. ..... 327/188
3,109,806 A * 11/1963 Weichart ..... 209/129

(Continued)

FOREIGN PATENT DOCUMENTS

JP 63-123453 A1 5/1988

(Continued)

OTHER PUBLICATIONS

International Search Report for International Application NO. PCT/JP02/02878 dated Jul. 9, 2002 from the Japanese Patent Office.

*Primary Examiner*—Joseph C. Rodriguez
*Assistant Examiner*—Jonathan R Miller
(74) *Attorney, Agent, or Firm*—Marshall Gerstein & Borun LLP

(57) ABSTRACT

An electrostatic separation apparatus for conductive particles and insulating particles with reduced separation time and improved separating capability, comprises a substantially flat-plate shaped bottom electrode (26) provided on lower side, a substantially flat-plate shaped mesh electrode (22) provided above the bottom electrode (26) as spaced a predetermined distance apart from the bottom electrode (26) and having a number of openings (24) to allow particles to pass therethrough, a direct current power supply connected to at least one of the mesh electrode (22) and the bottom electrode (24), and a voltage is applied across the bottom electrode (22) and the mesh electrode (24), thereby forming a separation zone (10) between the electrodes.

33 Claims, 16 Drawing Sheets

U.S. PATENT DOCUMENTS 3,402,814 A * 9/1968 Morel et al. ..... 209/127.1
3,489,279 A * 1/1970 St. John ..... 209/130
3,496,413 A * 2/1970 Adams et al. ..... 361/226
3,635,340 A * 1/1972 Dunn ..... 209/130
3,702,312 A * 11/1972 Shook et al. ..... 502/74
3,919,437 A * 11/1975 Brown et al. ..... 427/459
3,960,738 A * 6/1976 O'Brien et al. ..... 430/137.1
4,038,049 A * 7/1977 Melcher et al. ..... 95/62
4,038,052 A * 7/1977 Melcher et al. ..... 96/77
4,172,028 A * 10/1979 Dunn ..... 209/12.2
4,374,727 A * 2/1983 Takahashi et al. ..... 209/127.3
4,380,965 A * 4/1983 Walling et al. ..... 118/621
4,779,163 A * 10/1988 Bickford et al. ..... 361/212
5,484,061 A * 1/1996 Dunn ..... 209/127.4
5,513,755 A * 5/1996 Heavilon et al. ..... 209/2
5,518,546 A * 5/1996 Williams et al. ..... 118/621
5,562,755 A * 10/1996 Fricke et al. ..... 95/58
5,570,789 A * 11/1996 Dunn ..... 209/12.2
6,320,148 B1 * 11/2001 Yoon et al. ..... 209/127.3
6,359,246 B1 * 3/2002 Essig et al. ..... 209/127.1
6,511,712 B1 * 1/2003 Poliniak et al. ..... 427/466

FOREIGN PATENT DOCUMENTS

JP 05-228397 A1 9/1993

* cited by examiner

METHOD FOR ELECTROSTATICALLY SEPARATING PARTICLES, APPARATUS FOR ELECTROSTATICALLY SEPARATING PARTICLES, AND PROCESSING SYSTEM

TECHNICAL FIELD

The present invention relates to an electrostatic separation method and an electrostatic separation apparatus used in recycling of wastes such as coal ash derived from a coal-fired boiler, waste plastic, garbage, or burned ash, removal of impurities contained in food, condensing of mineral substances, and the like. More particularly, the present invention relates to a method and apparatus for sufficiently dispersing a material containing electrically-conductive particles and electrically-insulating particles and efficiently separating the electrically-conductive particles from the electrically-insulating particles by an electrostatic force generated by applying a high voltage.

BACKGROUND ART

Prior arts described below are known as examples of an apparatus for separating a material containing conductive particles and insulating (non-conductive) particles by an electrostatic force into the conductive particles and the insulating particles.

Published Japanese Translation of PCT international application No. Hei. 11-509134 (U.S. Pat. No. 5,829,598) discloses a constitution in which a reciprocating insulating mesh conveyor belt is installed between flat-plate electrodes provided with a gap of several millimeters, and by generating friction between the particles, positively charged unburned particles are caused to move toward a negative electrode and negatively charged ash is caused to move toward a positive electrode. This prior art employs friction electrification.

Japanese Laid-Open Patent Application Publication No. Hei. 7-75687 discloses a technique in which dispersed coal ash is dropped to a grounded drum-shaped electrode, thereby separating insulating particles from conductive particles. Specifically, ash (insulating particles) adhere to a rotating drum and unburned particles (conductive particles) are attracted to a high-voltage rod provided in the vicinity of the drum, thereby separating the insulating particles from the conductive particles. This prior art employs induced electrification.

Japanese Laid-Open Patent Application Publication No. Hei. 10-235228 discloses a technique in which particles are electrified by corona discharge and are freely dropped between electrode plates, thereby separating the insulating particles from the conductive particles. This prior art utilizes difference in dropping tracks due to difference in amount of electrified particles.

However, in the prior art disclosed in Published Japanese translation of PCT international application No. Hei. 11-509134 (U.S. Pat. No. 5,829,598), the conveyor belt is adapted to reciprocate in a small gap between the flat-plate electrodes for the purpose of applying friction electrification to the particles. This inevitably results in wear of the belt and the electrode plates, and these components need to be replaced. Therefore, a long-time operation is impossible without maintenance.

In the prior art disclosed in Japanese Laid-Open Patent Application Publication No. Hei. 7-75687, there is no function to disperse powdered material adhering to the rotating drum, which would lead to reduced separating capability due to aggregation.

When much powdered material is fed onto the drum, the layer thickness of the powdered material adhering onto the drum becomes large, which prevents movement of the powdered material on the lower side of the powdered material layer by the electrostatic force, so that separating capability is reduced. Because of the reduced separating capability, the amount of material to be treated is necessarily limited. This makes it possible for a large amount of material to be treated. Also, since the electrode in the vicinity of the drum is rod-shaped, the distance between the powdered material on the drum and the rod-shaped electrode is not constant. An electric field strength varies according to the distance. The separating capability is more degraded in a spot more apart from where the distance is the shortest. In particular, in case of fine powders, the separating capability would be degraded.

In the prior art disclosed in Japanese Laid-Open Patent Application Publication No. Hei. 10-235228, the moving speed of the particles is low because of their free drop. For satisfactory separation utilizing difference in the dropping track, the size of the apparatus need to be increased. Also, in order to perform repeated process for improved separating precision, the apparatus becomes complex and a large amount of material is difficult to treat.

Further, in the above-mentioned prior arts, operating conditions are fixed. Therefore, the separating capability might be sometimes significantly degraded when the particles to be separated have different characteristics.

DISCLOSURE OF THE INVENTION

In order to achieve the above-described object, according to the present invention, there is provided an electrostatic separation method of separating a powdered material containing conductive component and insulating (no-conductive) component into the conductive component and the insulating component by an electrostatic force, comprising: applying a voltage across a bottom electrode of a substantially flat-plate shape and a mesh electrode of a substantially flat-plate shape, the mesh electrode being provided above the bottom electrode and having a number of openings; generating a direct current electric field between one of the bottom electrode and the mesh electrode as positive (+) electrode and the other electrode as negative (−) electrode, to form a separation zone by an electrostatic force; and causing the conductive component in the material fed into the separation zone to move through the openings of the mesh electrode to be separated above the separation zone.

With the electrostatic separation method, time required for separation is significantly reduced and separating capability of the conductive particles and the insulating particles is improved. Besides, because of absence of wear due to contact with a driving portion, a long-time continuous operation without maintenance becomes possible.

In the method of the present invention, preferably, a gas dispersing plate having air permeability is used as the bottom electrode and a dispersing gas is introduced from underside of the gas dispersing plate. This is because dispersivity of the material is improved. In this case, preferably, the dispersing gas is pre-dehumidified, because consolidation and aggregation of the material is prevented. Also, since the separation zone is set to be in dehumidified atmosphere, the voltage being applied is increased during separation and the separating capability is improved.

In the method of the present invention, preferably, vibration or impact is applied to the bottom electrode and/or the mesh electrode. This is because dispersivity of the material is improved and adhesion of the material to the electrode is suppressed.

In the above method of the present invention, preferably, a plurality of mesh electrodes are multi-layered as spaced from one another, and a voltage is applied across the mesh electrodes to form a separation zone. This is because separating capability of the conductive component and the insulating component is improved. In this case, by changing the number of mesh electrodes, the dispersing capability (purity, recovery rate) can be easily set.

In the above method of the present invention, preferably, a material is fed to an upper end portion of the bottom electrode with the bottom electrode and the mesh electrode inclined, and insulating component is recovered from a lower end portion of the bottom electrode. This is because the material can be treated in large amount and continuously. In this case, by varying the inclination angle of the electrode or the length of the mesh electrode in the inclination direction, the separating capability (purity, recovery rate) can be easily changed and set.

In the above method of the present invention, preferably, a direct current (d.c.) voltage being applied across the electrodes is varied. This is because separating capability is improved. Also, preferably, the d.c. voltage being applied across the electrodes is pulsated. This is because particle layer formed on the electrode by electrification can be peeled, adhesion of the powdered material to the electrode can be suppressed, and dispersing capability can be improved. The pulsation of the voltage means that the electrodes are short-circuited and the applied voltage is set to 0 kV every several seconds.

In the method of the present invention, preferably, the conductive component is recovered by outwardly suctioning a gas in a space above the separation zone together with the conductive component. This is because separation of the conductive component is promoted. As a result, recovery of the insulating component is also promoted. In this case, a member having a number of suction holes is provided in a side portion of a space above the separation zone or an upper portion of the space above the separation zone, and the gas in the space above the separation zone is suctioned outwardly together with the conductive component through the suction holes. Thereby, the conductive particles can be quickly removed from the separation zone, action of air flow within the separation zone can be suppressed, and the conductive particles can be recovered without degradation of the separation capability. Thus, the material can be treated in large amount and continuously.

In the method of the present invention, amount of recovered insulating particles or amount of conductive particles that pass through the openings of the mesh electrode is metered, and according to metered recovery rate or metered variation in amount of the conductive particles, at least one of amount of suctioned gas for recovering the conductive particles and the amount of the fed powdered material is adjusted. This is because the recovery of the insulating component is stabilized regardless of variation in characteristic of the material and a continuous operation is performed while keeping stable separating capability.

In the above method of the present invention, preferably, at least one of stirring, heating, and addition of dispersing agent is performed on the powdered material before being fed into the separation zone. This is because the dispersivity of the material can be improved.

In the above method of the present invention, preferably, when the fed powdered material contains unburned component, the unburned component is recovered as well as the conductive particles. Mercury, HCl, DXN (dioxin), and the like which would be hazardous in abandonment or re-use are recovered as well as the conductive particles (unburned carbons). Thereby, purity of the wastes is improved and safety is improved.

According to the present invention, there is provided an electrostatic separation apparatus for separating a powdered material containing conductive component and insulating component into the conductive component and the insulating component by an electrostatic force, comprising: a substantially flat-plate shaped bottom electrode provided on lower side; a substantially flat-plate shaped mesh electrode provided above the bottom electrode as spaced a predetermined distance apart from the bottom electrode and having a number of openings to allow particles to pass therethrough; and a direct current power supply connected to at least one of the mesh electrode and the bottom electrode, wherein a voltage is applied across the bottom electrode and the mesh electrode to form a separation zone between the electrodes.

With the electrostatic separation apparatus, time required for separation can be significantly reduced, and the dispersing capability of the conductive particles and the insulating particles can be improved. Besides, long-time continuous operation without maintenance is possible because of absence of wear due to contact with the driving portion.

Preferably, the electrostatic separation apparatus, further comprises a material feed portion provided at one end portion between the bottom electrode and the mesh electrode and a recovery portion of the insulating component provided at the other end portion. This is because, since the conductive particles are removed from the separation zone through the mesh electrode by feeding the powdered material into the separation zone, the separation of the conductive component and the insulating component is accomplished by recovering the remaining particles from the other end portion of the separation zone.

In the apparatus, preferably, the bottom electrode constitutes a gas dispersing plate by giving air permeability to the bottom electrode, and the apparatus further comprises an air box provided under the gas dispersing plate for introducing dispersing gas, and the gas is ejected from the gas dispersing plate. This is because dispersivity of the fed powdered material can be improved and the separation zone can be set in dehumidified atmosphere.

Preferably, the apparatus further comprises a vibration applying means (vibrator) or an impact applying means (knocker or the like) mounted to the bottom electrode and/or the mesh electrode, for applying vibration or impact to the electrode. This is because the dispersivity of the material is improved and adhesion of the material to the electrode can be suppressed.

Preferably, the apparatus further comprises a plurality of mesh electrodes layered as spaced a predetermined distance apart from one another, a d.c. power supply is connected to at least one of the mesh electrodes, and a separation zone in a high electric field atmosphere is formed between the mesh electrodes. This is because the separation capability of the conductive component and the insulating component can be improved.

In the apparatus, preferably, the bottom electrode and the mesh electrode are provided as being inclined, the material feed portion is provided at an upper end portion of the bottom electrode, a recovery portion of the insulating component is connected to a lower end portion of the bottom electrode, the conductive component is adapted to move through openings of the mesh electrode and to be recovered above the separation zone, and the insulating component is adapted to be recovered at a lower end portion of the bottom electrode. This is because separation of the insulating component and the conductive component can be performed in large amount and continuously.

Preferably, the apparatus further comprises a direct current high-voltage generator capable of varying a voltage being applied across the electrodes. This is because the electric field strength in the separation zone is varied and the separating capability is improved. Also, preferably, the apparatus further comprises a direct current high-voltage generator capable of pulsating the voltage being applied across the electrodes. By suppressing adhesion of the powdered material to the electrode, the separating capability of the conductive particles and the insulating particles can be enhanced.

Preferably, the apparatus further comprises a suction device connected to a space above the separation zone. Since the gas in the space above the separation zone is suctioned outwardly together with the conductive component, the separation of the conductive component is promoted. As a result, the recovery of the insulating component is also promoted.

Preferably, the apparatus comprising the suction device further comprises a pipe or a plate provided in a side portion of a space above the separation zone or in an upper portion of the space above the separation zone, the pipe or the plate having a number of suction holes to allow particles to pass therethrough, and air in the space above the separation zone is suctioned through the suction holes. Since the gas is suctioned in the direction perpendicular to the direction in which the conductive particles move through the mesh electrode, it can be suctioned at a uniform flow rate in the longitudinal direction of the separation zone (direction in which the powdered material moves). Thereby, separation of the insulating component and the conductive component can be performed in large quantity and continuously.

Preferably, the apparatus of the present invention comprises at least one of a meter (load cell or the like) for continuously metering a recovery rate of the insulating particles and a meter (laser beam transmittance meter, contact dust monitor, or the like) for metering amount of the conductive particles that pass through the mesh electrode. This is because, according to the recovery rate or variation in the amount of the conductive particles, which is metered by the meter, the amount of the suctioned gas for recovering the conductive particles, the amount of the fed powdered material, and the like can be adjusted. By doing so, recovery of the insulating component can be stabilized regardless of variation in characteristic of the material, and continuous operation can be performed while keeping stable separating capability.

A production system of the present invention is configured such that a classifier is combined with one of the above-mentioned electrostatic separation apparatuses. This makes it possible to produce fine powders containing less impurities without the conductive particles.

BEST MODE FOR CARRYING OUT THE INVENTION

Hereinafter, an embodiment of the present invention will be described. The present invention is not intended to be limited to the embodiment described below, but may be suitably altered.

Figure 1:
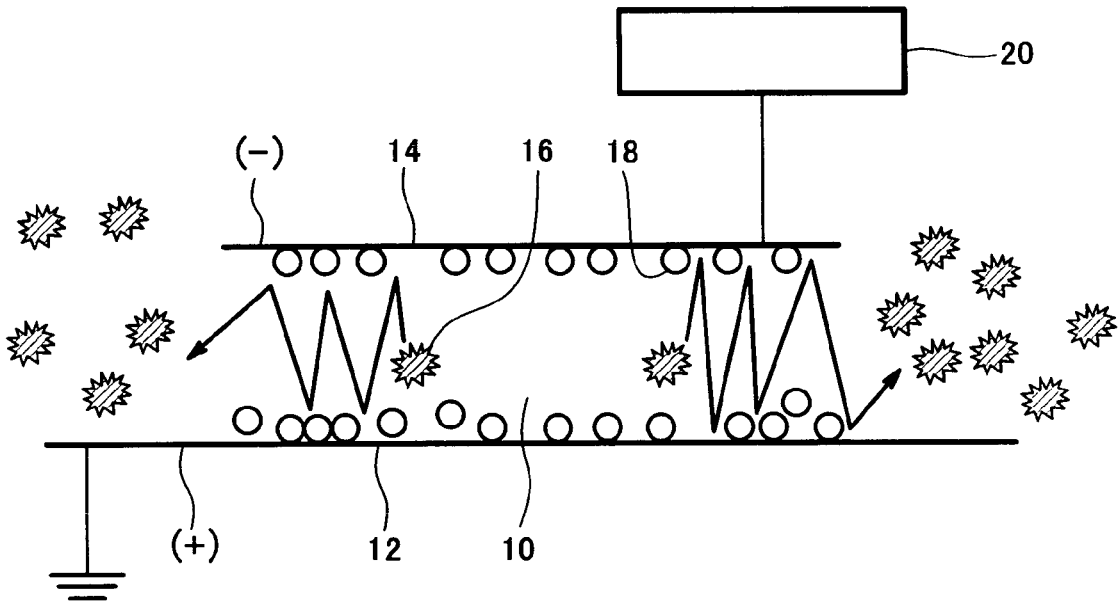
FIG. 1 is a side view schematically showing an electrostatic separation apparatus, to explain a principle of electrostatic separation of the present invention.

First of all, a principle of electrostatic separation of the present invention will be described with reference to FIGS. 1 and 2. As shown in FIG. 1, a material as a mixture of electrically-conductive (conductive) particles 16 and electrically-insulating (insulating) particles 18, for example, coal ash containing unburned component (conductive particles 16) and ash (insulating particles 18) is put into an electrostatic separation zone 10 between a flat-plate shaped positive (+) electrode 12 and a flat-plate shaped negative (−) electrode 14, and a voltage is applied across the electrodes to generate an electric field of 0.2 to 1.5 kV/mm. 20 denotes a direct current (d.c.) high-voltage power supply.

Figure 2:
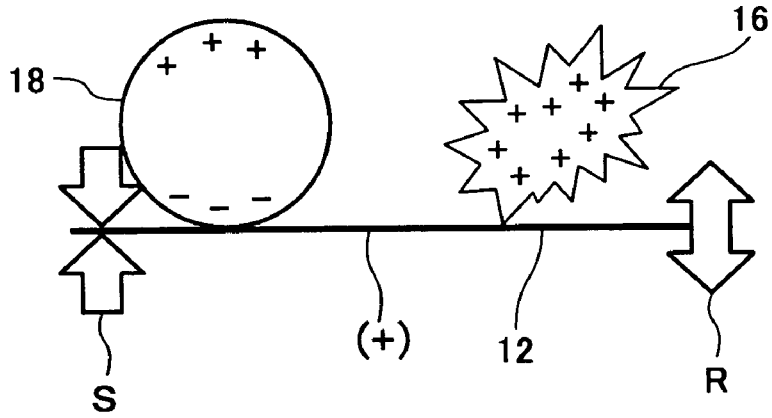
FIG. 2 is an enlarged view of conductive particles and insulating particles in FIG. 1.

As shown in FIGS. 1 and 2, the insulating particles 18 are caused to polarize due to induced electrification in a high electric field, and negatively charged particles are attracted to the positive electrode 12 (arrow S in FIG. 2), while positively charged particles of the polarized insulating particles 18 are attracted to the negative electrode 14. As a result, the insulating particles 18 remain between the electrodes. Meanwhile, when the conductive particles 16 are attracted to the positive electrode 12, they are positively charged by induction and generate a repulsive force with the positive electrode 12 (arrow R in FIG. 2). The particles 16 move upward and are attracted to the negative electrode 14. At the negative electrode 14, the conductive particles 16 are negatively charged and generates a repulsive force with the negative electrode 14, so that the particles 16 are attracted to the positive electrode 12. This action is repeated, thereby causing the conductive particles 16 to fly out of the electrostatic separation zone 10 between the electrodes in a high electric field atmosphere. In this manner, separation of the insulating particles and the conductive particles is carried out by utilizing difference in characteristic between action of the electric field on the insulating particles and action of the electric field on the conductive particles.

In the above case, when the electrostatic separation zone has an electric field strength greater than 1.5 kV/mm, the insulating particles sometimes fly out of the electrostatic separation zone, as well as the conductive particles, while under the electric field strength less than 0.2 kV/mm, sufficient induced electrification is not applied to the particles, so that the conductive particles remain in the electrostatic separation zone as well as the insulating particles. As a result, effective electrostatic separation is difficult to achieve. Accordingly, it is necessary to set the electric field atmosphere of the electrostatic separation zone to 0.2 to 1.5 kV/mm. In this case, a lower limit value of the electric field strength under which effective electrostatic separation is conducted is 0.3 kV/mm and an upper limit value thereof is 0.8 kV/mm.

As shown in FIG. 1, when the flat-plate shaped electrode is used, the conductive particles fly out of the electrostatic separation zone while repeating up-down movement within the electrostatic separation zone. While the conductive particles are flying out of the electrostatic separation zone, a driving force for horizontal movement is not acting on the conductive particles. For this reason, it takes long time for the conductive particles to fly to outside the electrostatic separation zone and hence, it takes time to complete separation, thereby resulting in degraded separating capability.

Figure 3:
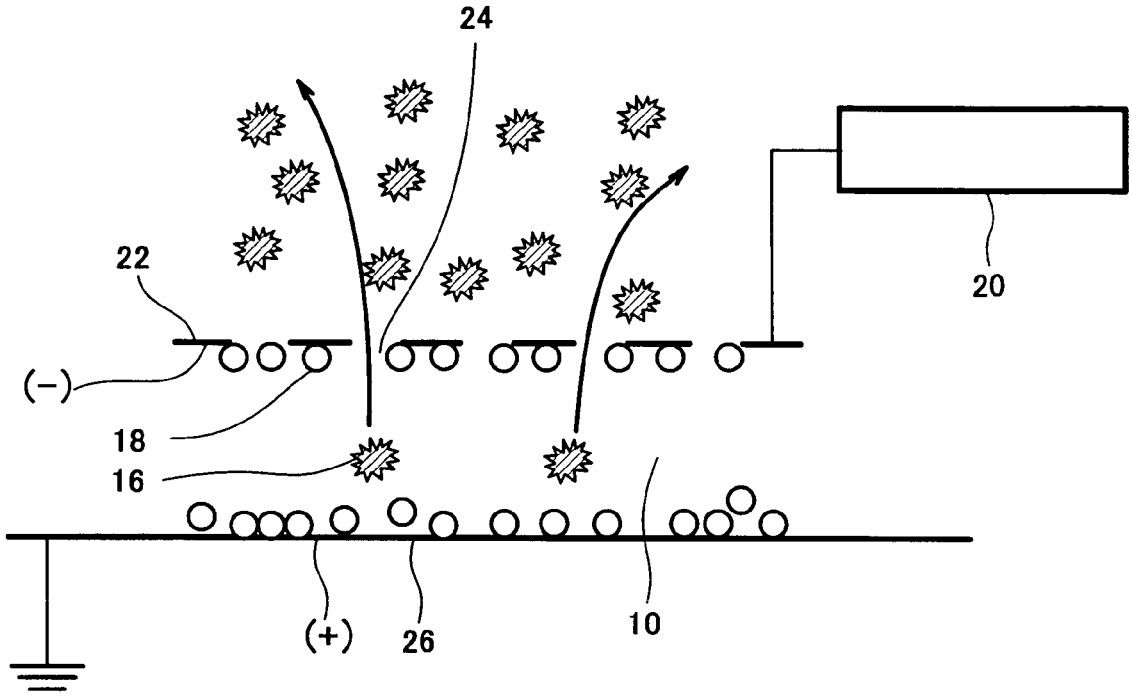
FIG. 3 is a longitudinal sectional view schematically showing an electrostatic separation apparatus according to an embodiment of the present invention.

As a solution to this, as shown in FIG. 3, the mesh electrode 22 is used as a negative electrode, and the conductive particles 16 are adapted to pass through openings 24 of meshes, thereby allowing the conductive particles 16 to move to be separated above the negative electrode. Therefore, unlike the movement in FIG. 1, the particles need not move in the direction in which the driving force does not act. As s result, time required for separation is reduced and separating capability is improved. FIG. 3 shows an apparatus executing the electrostatic separation method according to a first embodiment of the present invention. A voltage is applied across a flat-plate shaped bottom electrode 26 as positive electrode (ground potential) and the mesh electrode 22 as negative electrode placed above the bottom electrode 26, thereby forming an electrostatic separation zone 10 in a high electric field atmosphere. The electric field atmosphere of the electrostatic separation zone 10 is set to 0.2 to 1.5 kV/mm, preferably 0.3 to 0.8 kV/mm as described above. Alternatively, the bottom electrode 26 may be negative electrode and the mesh electrode 22 may be positive electrode. Thus, the positive electrode and negative electrode may be set as desired.

The material as the mixture of the conductive particles 16 and the insulating particles 18, for example, coal ash containing unburned component (conductive particles 16) and ash (insulating particles 18) is fed into the electrostatic separation zone 10 between the bottom electrode 26 and the mesh electrode 22. Separation is conducted in the electric field atmosphere of 0.2 to 1.5 kV/mm, preferably 0.3 to 0.8 kV/mm. The conductive particles 16 are caused to move through the openings 24 of the mesh electrode 22 to be separated above the separation zone 10. In this case, the openings of meshes (apertures) less than 0.15 mm tend to get clogged. On the other hand, the openings of meshes greater than 50 mm causes uneven distribution of electric field strength and degraded separating capability. Therefore, preferably, the size of the openings are set to 0.15 to 50 mm. Principle of separation, and the other configuration and function are identical to those in FIGS. 1 and 2.

The electrodes are not necessarily placed in parallel. Nonetheless, when the distance between the electrodes exceeds 50 mm, a very large voltage is required to be applied to obtain the above-identified electric field strength, whereas when the distance between the electrodes is less than 2 mm, spark is frequently produced and the thickness of the powdered material layer is limited. This makes it possible to treat a large amount of powdered material. Therefore, preferably, the distance between the electrodes is set to 2 to 50 mm. As a preparation process of the material before being put into the zone, the particles or the powdered material is sufficiently stirred to be dispersed or given friction electrification, or dispersing agent such as calcium stearate, sodium stearate, or cement admixture, for the purpose of improved separating capability. Further, the material may be heated to improve dispersivity.

In order to address separation of various particles or powdered materials, for example, sorting of metals from wastes, removal of mercury, HCl, DXN (dioxin) from wastes, removal of impurities from mineral substances or food, and the like, operating conditions such as the voltage being applied may be varied to set separating capability (purity of separated substances, recovery rate).

Figure 4:
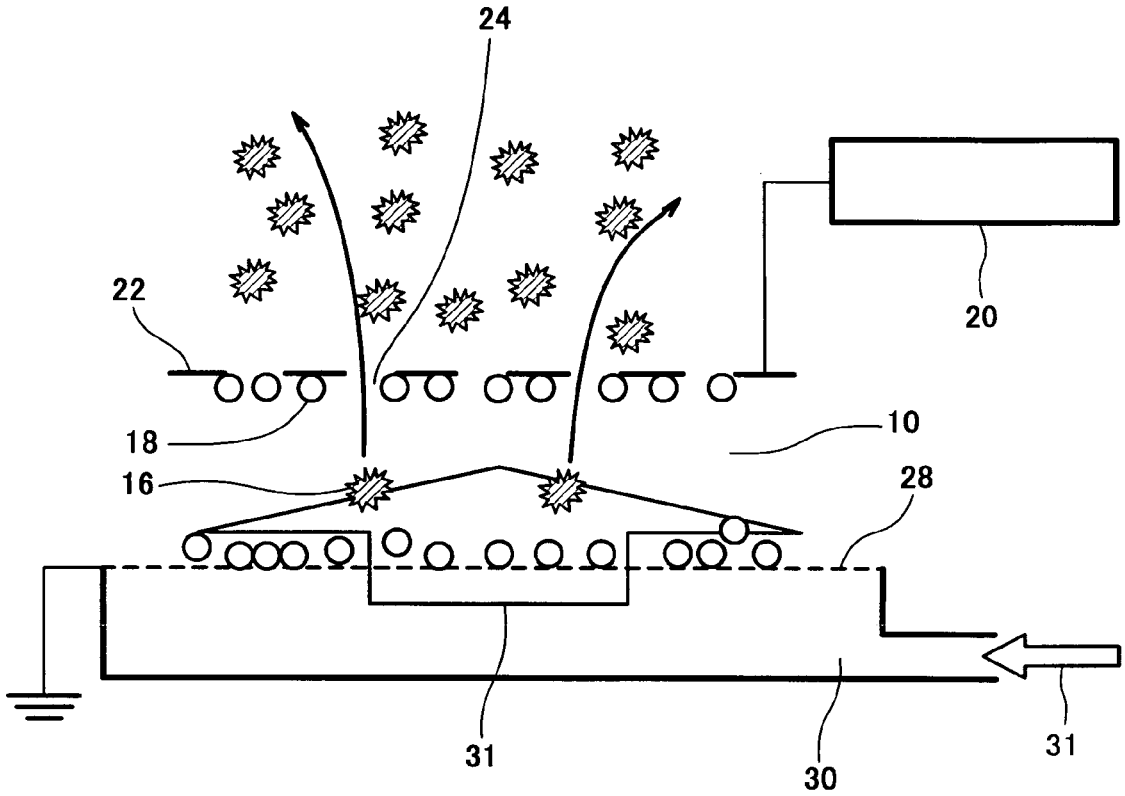
FIG. 4 is a longitudinal sectional view schematically showing an electrostatic separation apparatus according to another embodiment of the present invention.

FIG. 4 shows an apparatus executing an electrostatic separation method according to a second embodiment of the present invention. In this embodiment, a bottom electrode constitutes a gas dispersing plate 28 and an air box 30 is provided under the gas dispersing plate 28. The gas dispersing plate 28 is provided with a number of minute holes through which dispersing air 31 from the air box 30 flows. The gas dispersing plate 28 is manufactured from, for example, sintered metal having air permeability. The dispersing air 31 is introduced into the air box 30 and ejected into the separation zone 10 through the minute holes of the gas separating plate 28. The apertures of the gas dispersing plate 28 are required to be sized for the particles or powdered material not to drop therethrough. Thus, by using the bottom electrode as the gas dispersing plate, dispersivity of the particles or powdered material in the electrostatic separation zone 10 is improved, and separating capability is improved. In this case, as the introduced air, it is desirable to use dehumidified air (for example, dehumidified air of dew point of not higher than 0° C.) to prevent consolidation or aggregation of the particles or powdered material. The use of the dehumidified air allows the separation zone 10 to be in dehumidified atmosphere. Specifically, adhesion of moisture which would greatly affect the electrostatic separation capability is reduced (the particles with moisture tends to fly toward the conductive particles) and the voltage being applied can be set higher. As a result, the separating capability of one layer is improved. The other configuration and function are identical to those of the first embodiment.

Figure 5:
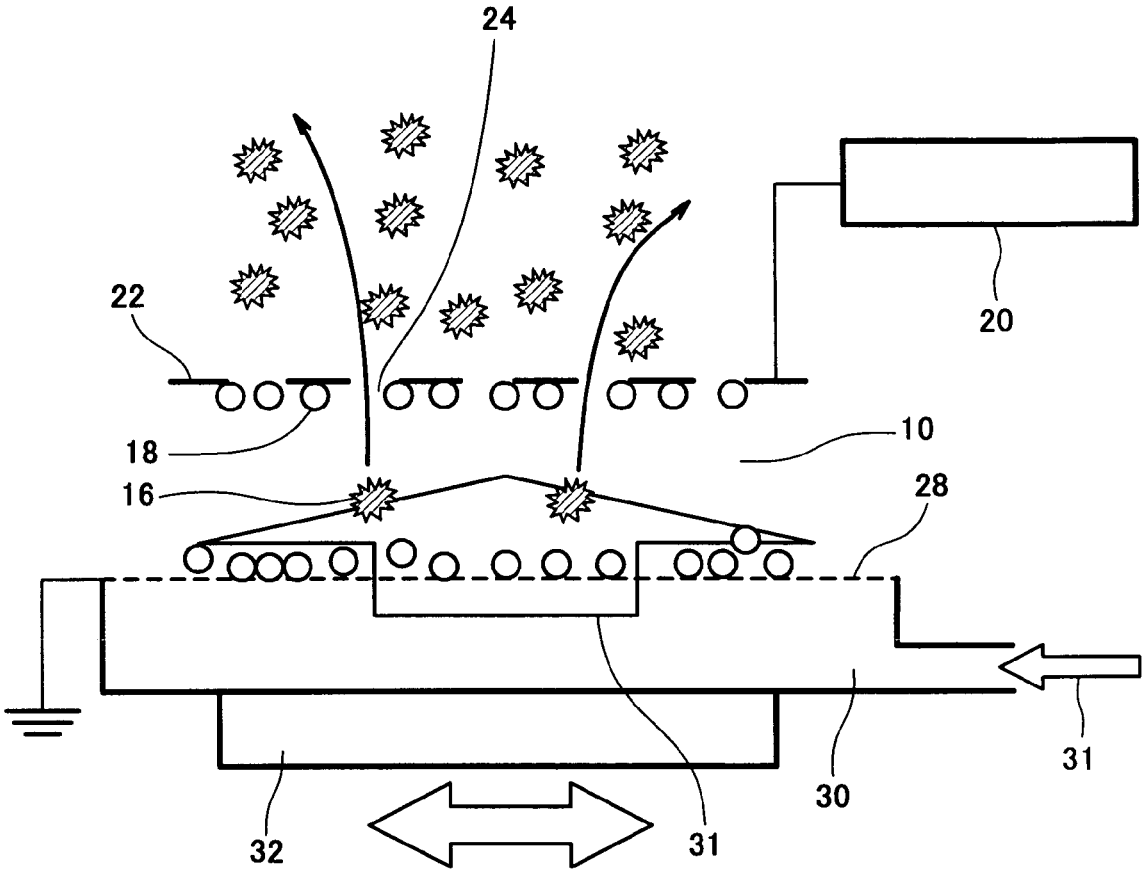
FIG. 5 is a longitudinal sectional view schematically showing an electrostatic separation apparatus according to another embodiment of the present invention.

FIG. 5 shows an apparatus for executing an electrostatic separation method according to a third embodiment of the present invention. In this embodiment, the bottom electrode constitute the gas dispersing plate 28, the air box 30 for introducing the dispersing air 31 is provided under the gas dispersing plate 28, and a vibrator or knocker 32 is mounted to the apparatus. By applying vibration or impact to the gas dispersing plate 28 as the bottom electrode and/or the mesh electrode 22 by using the vibrator or the knocker 32, the dispersion of the particles or the powdered material is facilitated and the separating capability is thereby improved. In addition, adhesion of the particles or the powdered material to the electrode can be suppressed. The other configuration and function are identical to those of the first and second embodiments.

Figure 6:
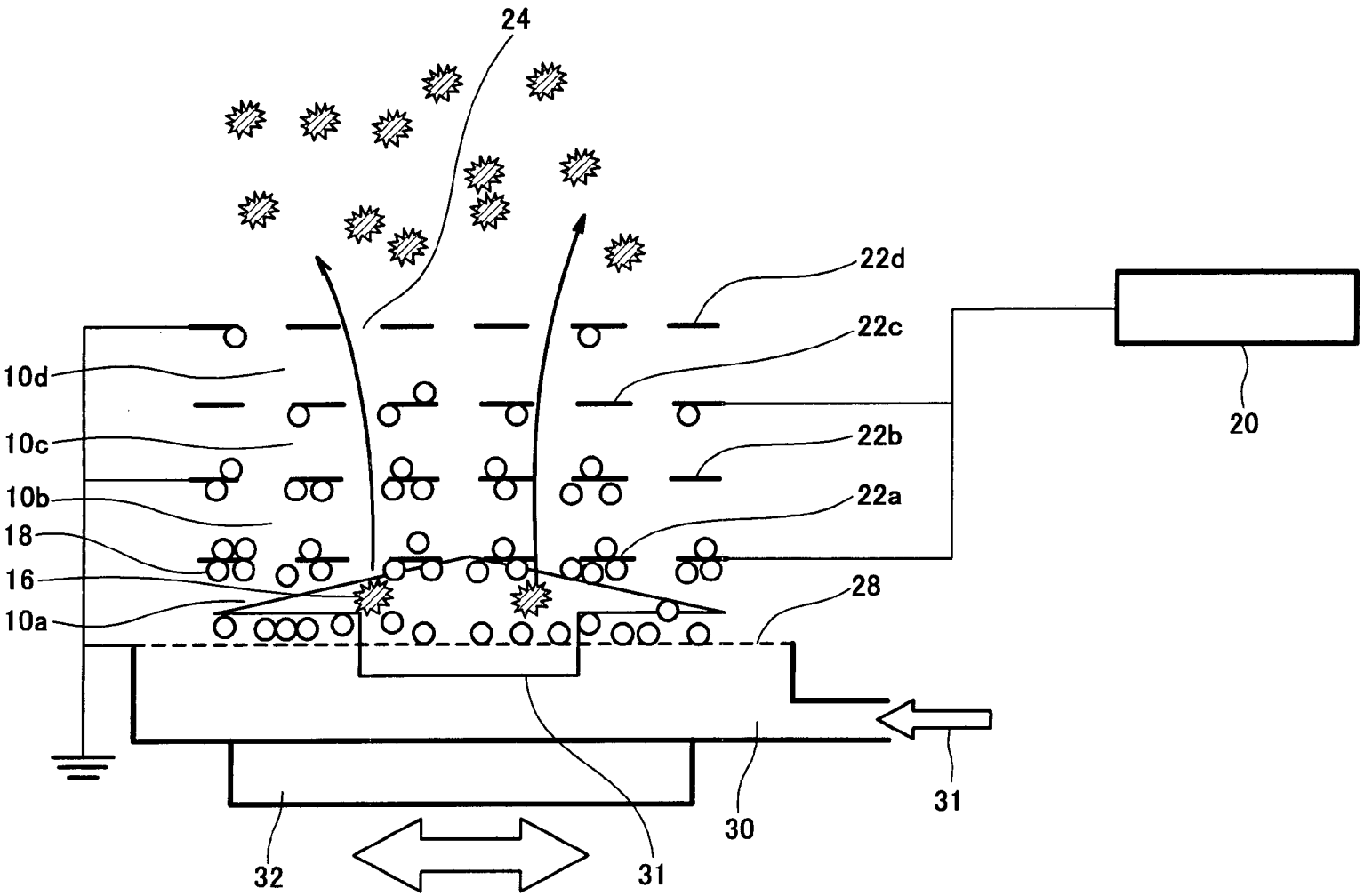
FIG. 6 is a longitudinal sectional view schematically showing an electrostatic separation apparatus according to another embodiment of the present invention.

FIG. 6 shows an apparatus for executing an electrostatic separation method according to a fourth embodiment of the present invention. In this embodiment, the bottom electrode constitute the gas dispersing plate 28, the air box 30 for introducing the dispersing air 31 is provided under the gas dispersing plate 28, and the vibrator or knocker 32 is installed on the apparatus. A plurality of mesh electrodes are layered at the predetermined intervals and the electrostatic separation zone is formed between the mesh electrodes. FIG. 6 shows an example in which four mesh electrodes 22*a*, 22*b*, 22*c*, 22*d* are multi-layered and electrostatic separation zones 10*a*, 10*b*, 10*c*, 10*d* are formed.

When satisfactory separation is not achieved by the electrostatic separation method described in the first, second and third embodiments (FIGS. 3, 4 and 5), the mesh electrodes are multi-layered as described in this embodiment. Thereby, since the particles passing through the mesh openings are repeatedly subjected to separating action according to the above-mentioned principle, purity of the conductive particles flying out of the electrostatic separation zone is improved. In addition, the recovery rate of the insulating particles is improved. As a result, the separating capability is improved. In this case, the separating capability (purity, recovery rate) can be set by changing the number of mesh electrodes. The other configuration and function are identical to those of the first, second, and third embodiments.

Figure 7:
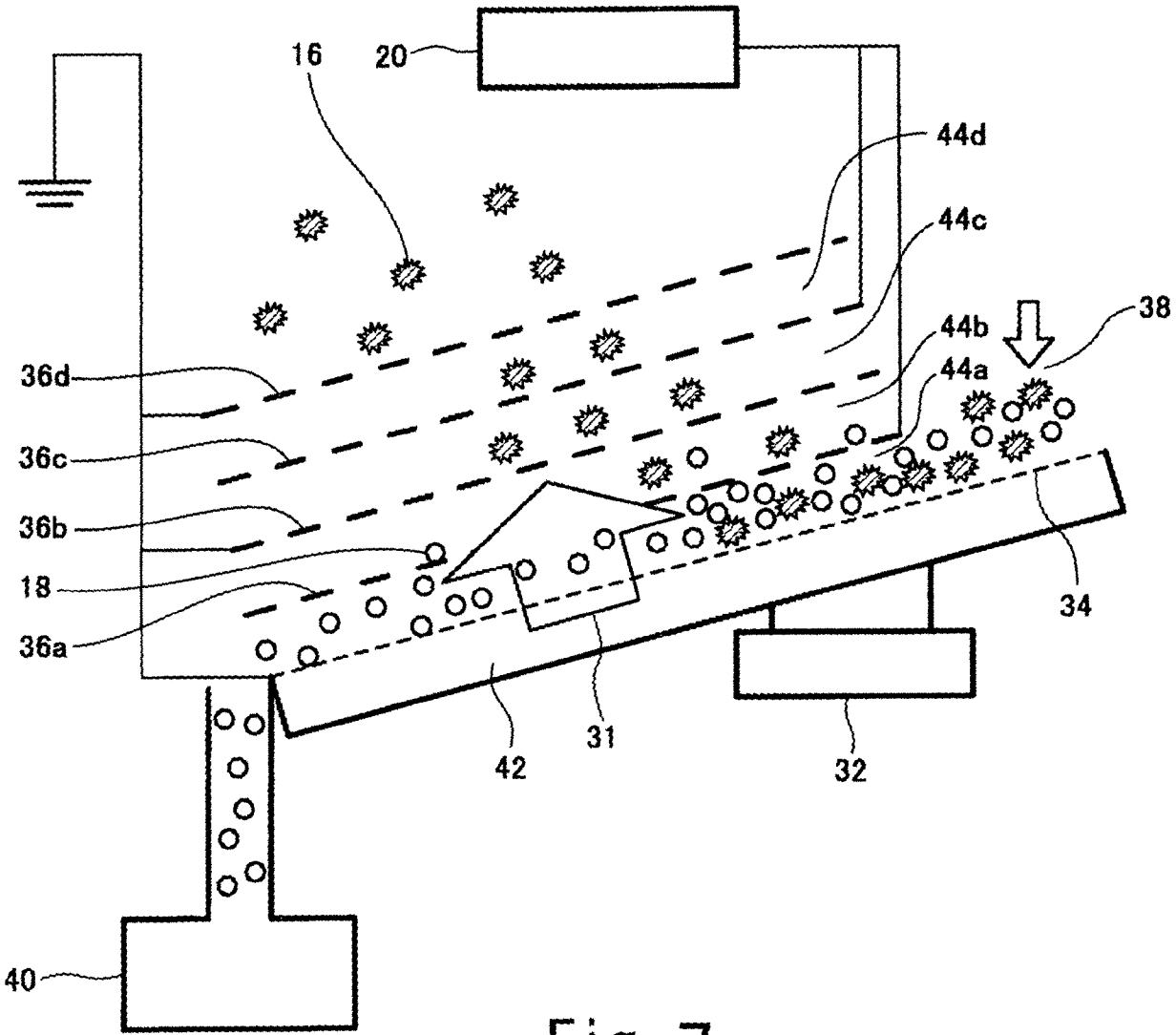
FIG. 7 is a longitudinal sectional view schematically showing an electrostatic separation apparatus according to another embodiment of the present invention.
Figure 8:
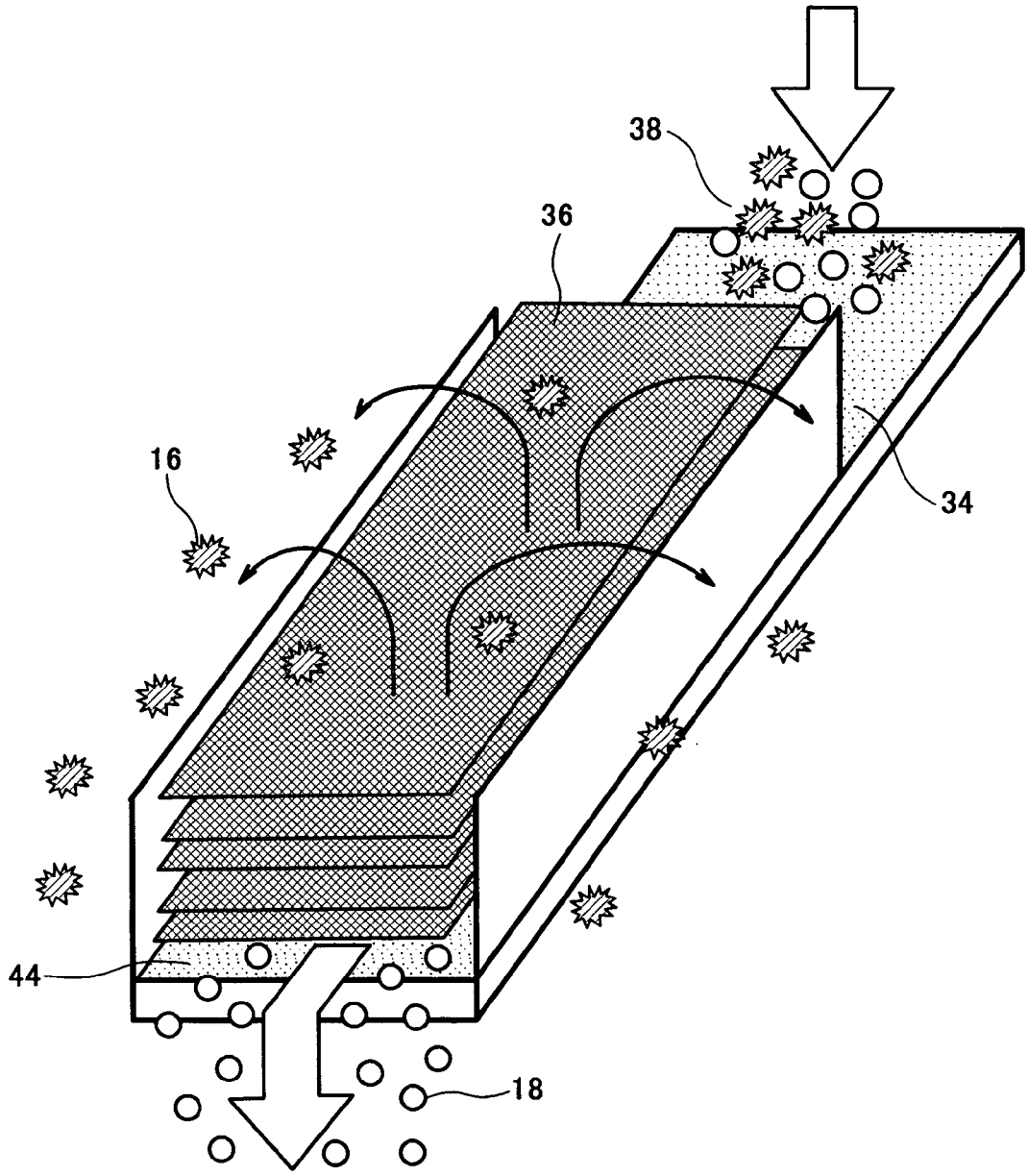
FIG. 8 is a perspective view schematically showing an electrostatic separation apparatus according to another embodiment of the present invention.
Figure 9:
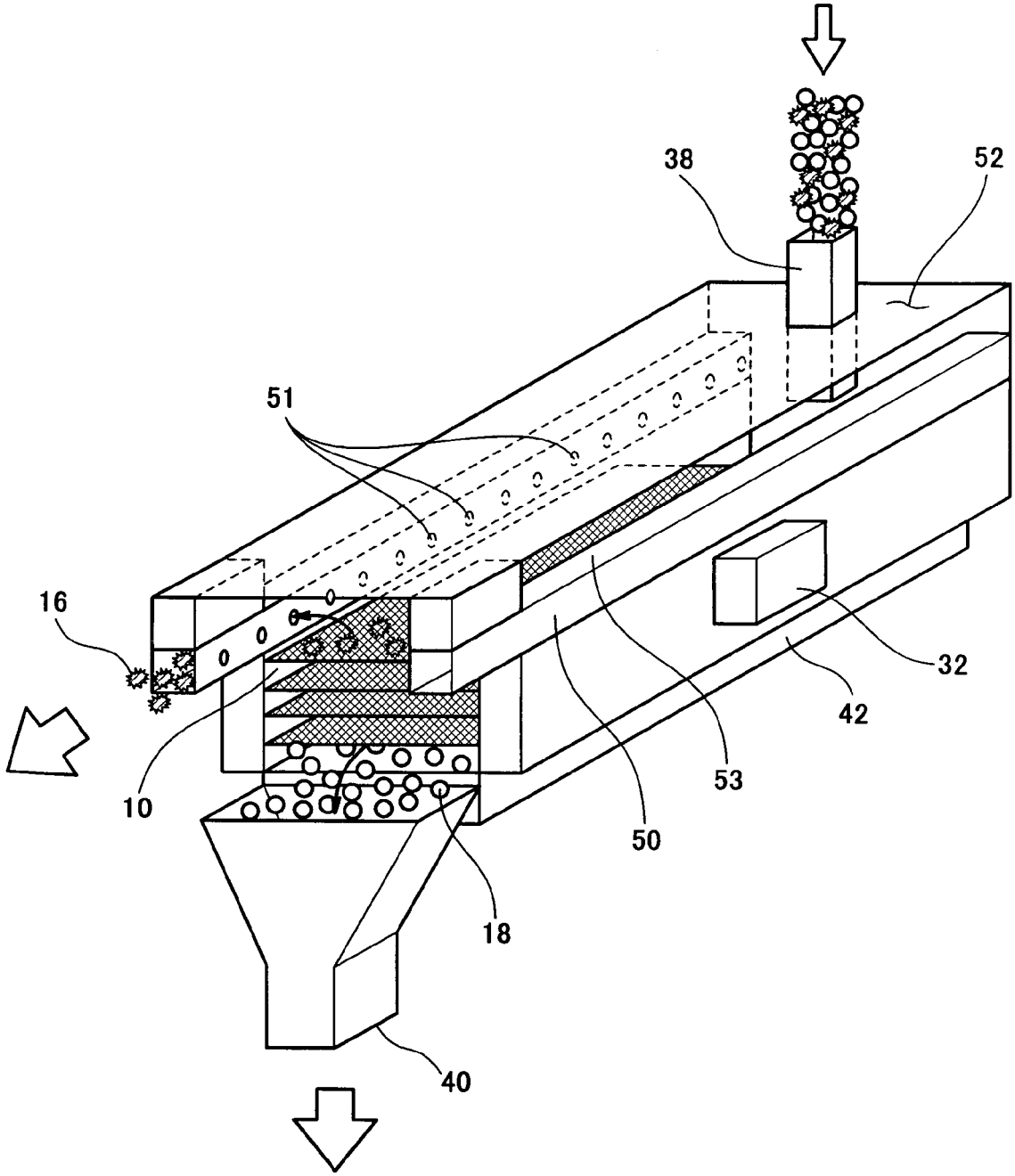
FIG. 9 is a perspective view schematically showing an electrostatic separation apparatus according to another embodiment of the present invention.

FIGS. 7, 8, and 9 show an apparatus for executing an electrostatic separation method according to a fifth embodiment of the present invention. In this embodiment, as shown in FIG. 7, a gas dispersing plate 34 as the bottom electrode and multi-layered mesh electrodes 36*a*, 36*b*, 36*c*, 36*d* are inclined. A material feed portion 38 is provided at an upper end portion of the gas dispersing plate 34 as the bottom electrode and an insulating particle recovery portion 40 is connected to a lower end portion of the gas dispersing plate 34. An air box 42 for introducing the dispersing air 31 is provided under the gas dispersing plate 34, and the vibrator or knocker 32 is mounted to the apparatus. FIG. 7 shows an example in which the four mesh electrodes 36*a*, 36*b*, 36*c*, 36*d* are multi-layered to form electrostatic separation zones 44*a*, 44*b*, 44*c*, 44*d*. Here, positive electrode and negative electrode are alternately arranged. The number of the mesh electrodes and arrangement of the positive electrode and negative electrode are not intended to be limited to this structure.

FIG. 8 is a perspective view of the apparatus of this embodiment. Here, by way of example, four mesh electrodes 36 are multi-layered and positive electrode and negative electrode are alternately arranged. A d.c. high-voltage generator (not shown) capable of generating a pulsating voltage (in the form of pulse) is connected to the mesh electrode. The voltage is applied in such a manner that the voltage is pulsated, specifically, the electrodes are short-circuited and the voltage being applied is set to OkV every several seconds. The cycle of the pulsation is shorter than the time during which the powdered material resides in the separation zone, and the time during which the voltage is low (or 0) is shorter than ½ of the residing time.

In the apparatus shown in FIG. 9, suction pipes 50 having suction holes 51 as a conductive particle recovery portion is provided in a side portion of a space above the separation zone 10 and connected to a suction device (not shown) such as a dust collector, or blower. In this apparatus, slits 53 for introducing ambient air are provided between the suction pipes 50 and a top face 52, but such structure is only illustrative. The position where the slits for introducing ambient air are installed needs to be selected so that the inside of the separation zone 10 is not affected by air flow by the suction. A suction mechanism above the separation zone 10 is not intended to be limited to the pipe, but instead, a plate having a number of holes (indicated by reference numeral 54 in FIG. 10) may be used. Alternatively, the holes may be replaced by slits. In brief, the mechanism needs to be capable of suction at a uniform flow rate along the longitudinal direction of the separation zone.

The amount of air suctioned by the suction pipe 50 is set to be greater than the amount of dispersing air introduced through the gas dispersing plate (bottom electrode) 28 and not to exceed three times the amount of dispersing air. When the amount of suctioned air is less than the amount of dispersing air, a positive pressure is created inside the separation apparatus, and the powdered material is blown out through the slits 53 for introducing ambient gases, together with internal gases. When the amount of suctioned air exceeds three times the amount of dispersing air, upward air flow generated in the separation zone 10 is greatly disordered, which would lead to reduced separating capability. By providing the slits 53 for introducing gases externally in the longitudinal direction of the separation zone 10 as described above, it is possible to minimize variation in the amount of dispersing air introduced through the gas dispersing plate 28, or effect on separating capability which would be produced by the variation in the amount of suctioned air for recovering the conductive particles.

Figure 10:
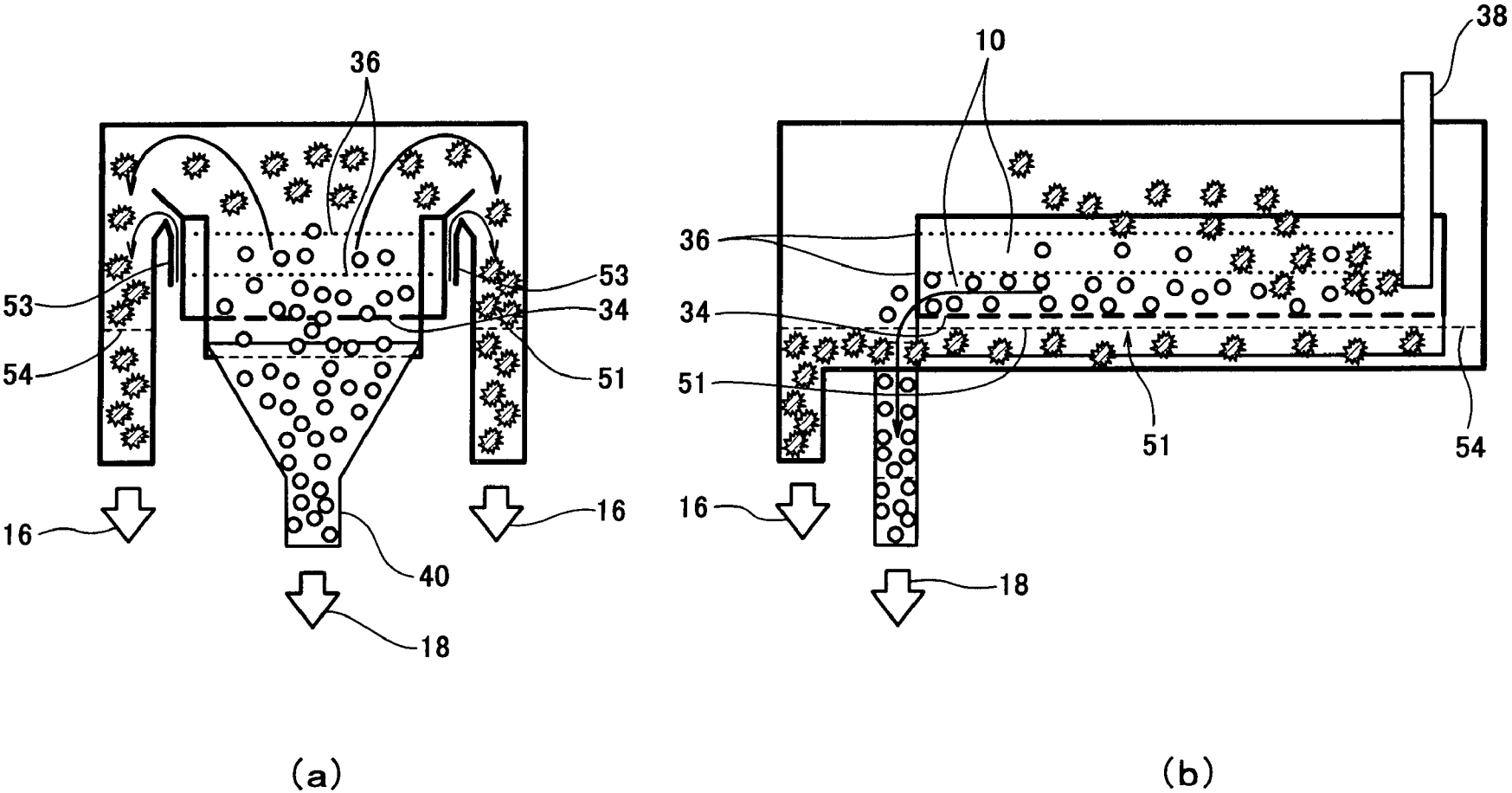
FIG. 10 is a view schematically showing an electrostatic separation apparatus according to another embodiment of the present invention, wherein FIG. 10(*a*) is a transverse sectional view and FIG. 10(*b*) is a longitudinal sectional view.
Figure 11:
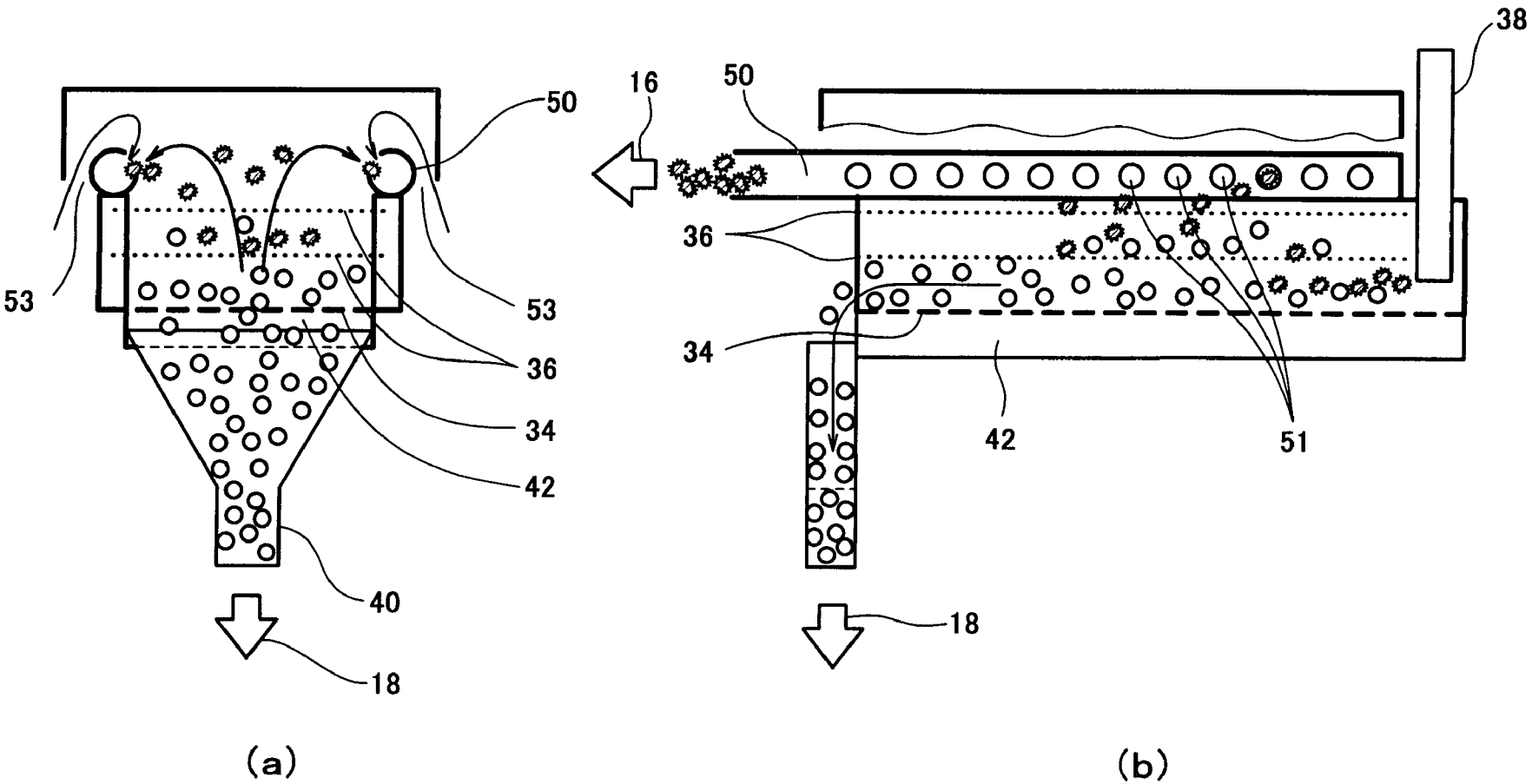
FIG. 11 is a view schematically showing an electrostatic separation apparatus according to another embodiment of the present invention, wherein FIG. 11(*a*) is a transverse sectional view and FIG. 11(*b*) is a longitudinal sectional view.

In this apparatus, the vibrator or the knocker 32 is mounted to a housing portion constituting the separation zone 10. Alternatively, as shown in FIG. 10, a suction mechanism such as suction plates 54 may be provided independently of a vibrating portion (housing) so as not to vibrate. Further, alternatively, as shown in FIG. 11, the suction pipes 50 may be connected to the housing or the like of the separation zone 10 to integrally vibrate.

Figure 12:
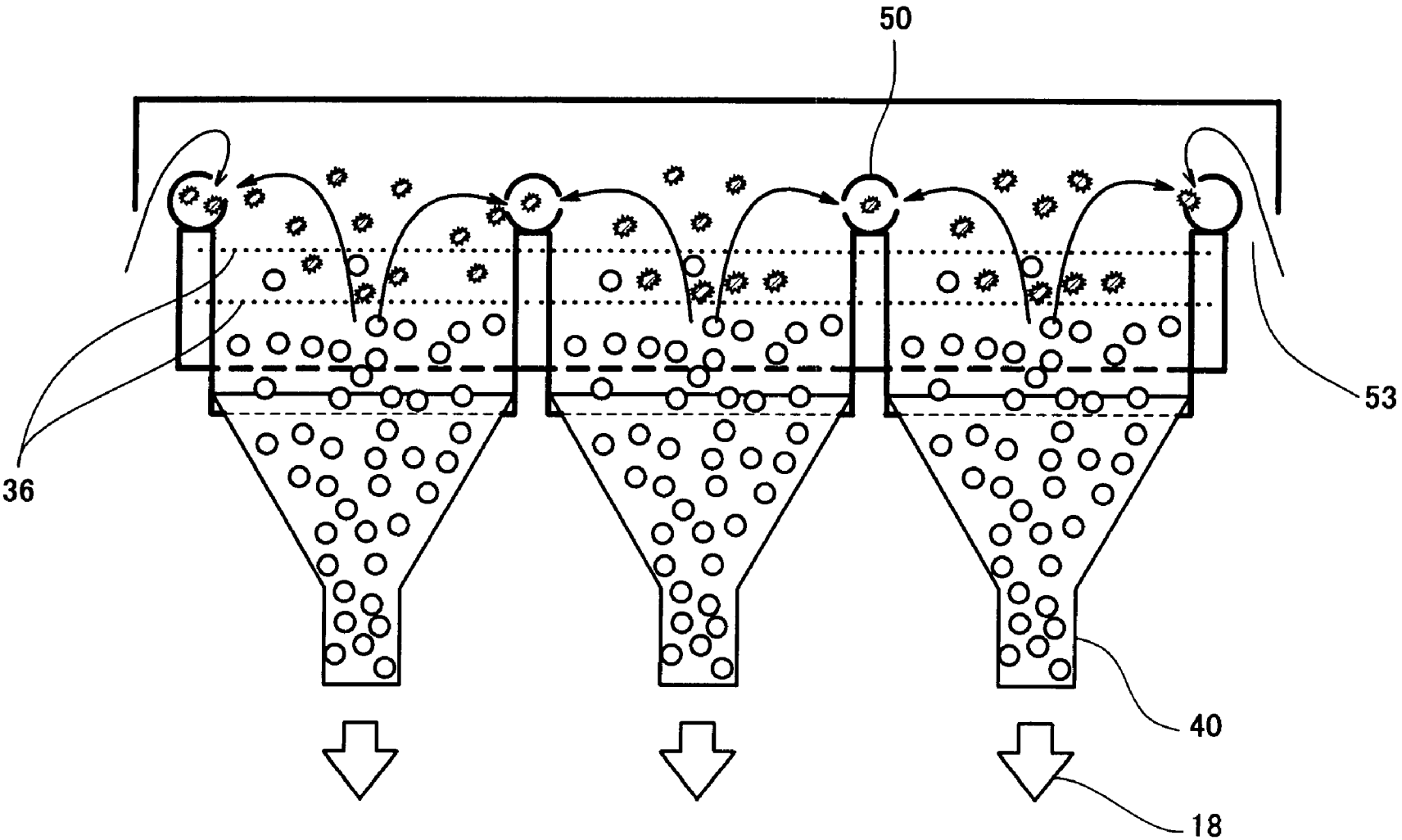
FIG. 12 is a transverse sectional view schematically showing an electrostatic separation apparatus according to another embodiment of the present invention.

By increasing the width of the separation zone 10 (in the direction orthogonal to the direction along which the powdered material moves) and the length of the separation zone 10 (in the direction along which the powdered material moves), a large amount of material can be treated without degradation of separating capability. Instead of a general structure in which a hood is mounted in the space above the separation zone 10, the size of the apparatus can be reduced by providing the suction mechanism 50 as shown in FIG. 12. As the result, a large amount of material can be treated by using a small apparatus. A plurality of the above-mentioned electrostatic separation apparatuses may be arranged along the longitudinal direction to allow a large amount of material to be treated.

As described in the above embodiment, the gas dispersing plate as the bottom electrode and the mesh electrode are inclined, the material is fed to the upper end portion of the dispersing plate, the insulating particles are recovered by the lower end portion thereof, and the conductive particles are recovered in the side portion of the space above the separation zone or in the upper portion of the space above the separation zone. Thus, the material can be treated in large amount and continuously. In order to address separation of various particles or powdered materials, for example, separation of unburned component and ash in coal ash, sorting metals from wastes, removal of mercury, HCl, DXN (dioxin) from waste, removal of impurities from mineral substances or food, and the like, the separating capability (purity of separated particles, recovery rate) can be set by varying operating conditions such as varying the voltage being applied, pulsating the voltage being applied, or inclining the separation zone 10. Further, when it is difficult to treat various particles or powdered material only by varying the operating conditions such as applied voltage or inclination angle, the separating capability (purity of separated particles, recovery rate) can be changed easily and greatly by varying the longitudinal (inclination direction) length of the mesh electrode and/or the number of mesh electrodes, which enables electrostatic separation of all kinds of the particles or powdered material containing the conductive component and the insulating component.

The other configuration and function are identical to those of the first to fourth embodiments.

Figure 13:
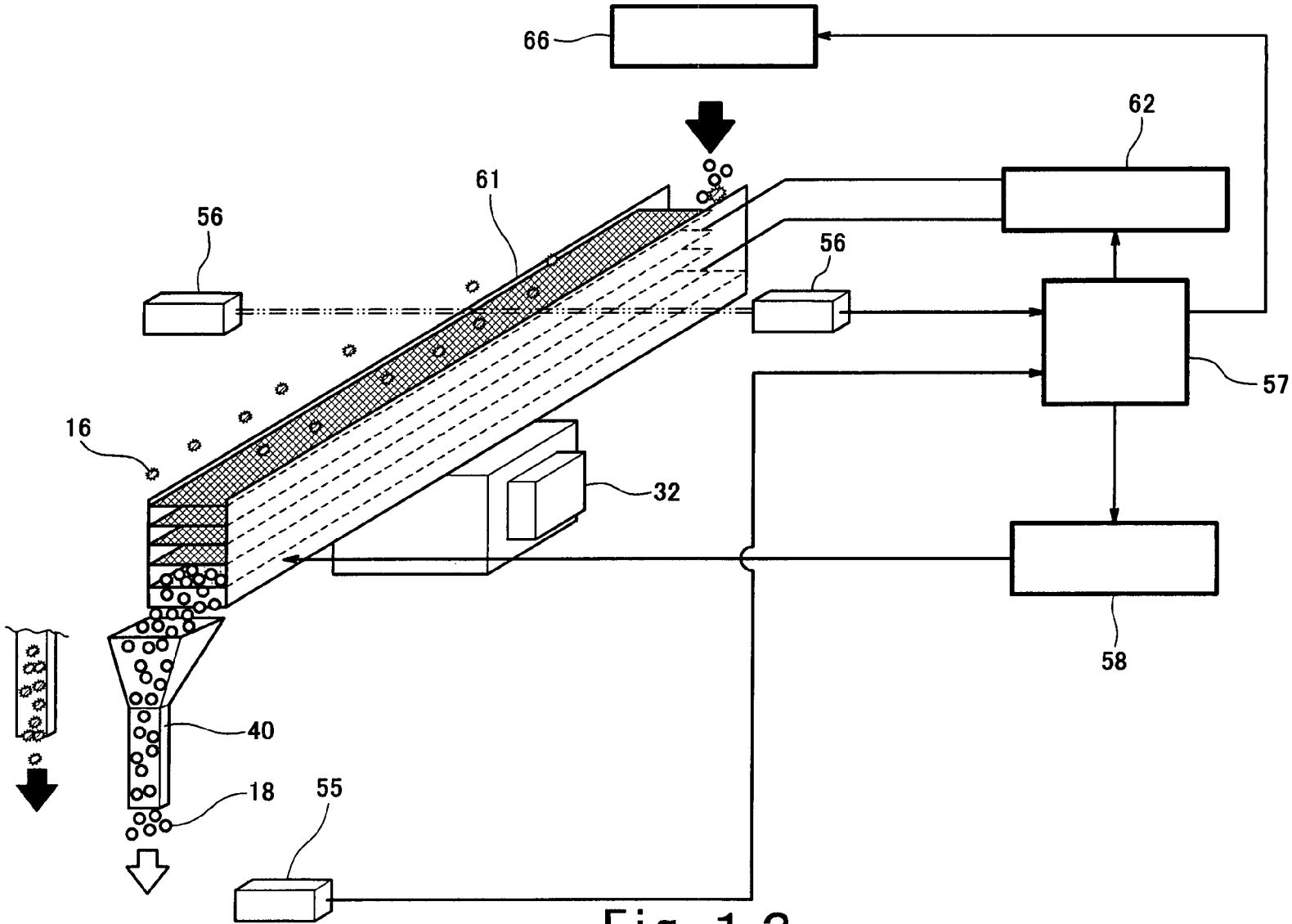
FIG. 13 is a perspective view schematically showing an electrostatic separation system according to an embodiment of the present invention.

FIG. 13 shows an apparatus for executing an electrostatic separation method according to a sixth embodiment of the present invention. As shown in FIG. 13, the recovery portion 40 of the insulating particles is provided with a load cell 55 as a recovery amount meter for metering the amount of the recovered insulating particles. A laser beam transmittance meter 56 is provided above the separation zone 10, as a meter for metering the amount of conductive particles that have passed through the mesh electrode 36. According to the variation in the amount of recovered insulating particles or the amount of the conductive particles that have been metered by the meters 55, 56, a control device 57 is adapted to control the voltage being applied by a d.c. voltage generator 62, the amount of material being fed by a material feeder 66 by adjusting the number of rotations of a motor of the material feeder 66, and the amount of dispersing gas by adjusting an adjustment valve 58 for adjusting the amount of introduced dispersing gas. Thus, adjustment is made so that the stabilized recovery amount is obtained. When the amount of recovered insulating particles is reduced or the amount of the conductive particles that have passed is increased, the voltage being applied is reduced and the amount of material being fed is increased, or the amount of dispersing gas is increased. In the electrostatic separation, due to slight difference in particle characteristic (moisture, particle diameter, separation atmosphere, etc), the separating capability varies even under uniform conditions. But, by executing a continuous operation according to the above-mentioned method, it is possible to execute an operation with the recovery rate of the insulating particles stabilized regardless of the characteristic of material particles.

A material containing carbons as impurity, for example, coal ash derived from the coal-fired boiler, is inferior in quality, for use as the cement admixture or the like. Also, mercury, HCl, DXN (dioxin), or the like is accumulated in the conductive component more than in the insulating component (ash). Accordingly, by removing the conductive particles, the stability and purity of the recovered insulating particles is improved and, as a result, quality of the cement admixture is improved.

Figure 14:
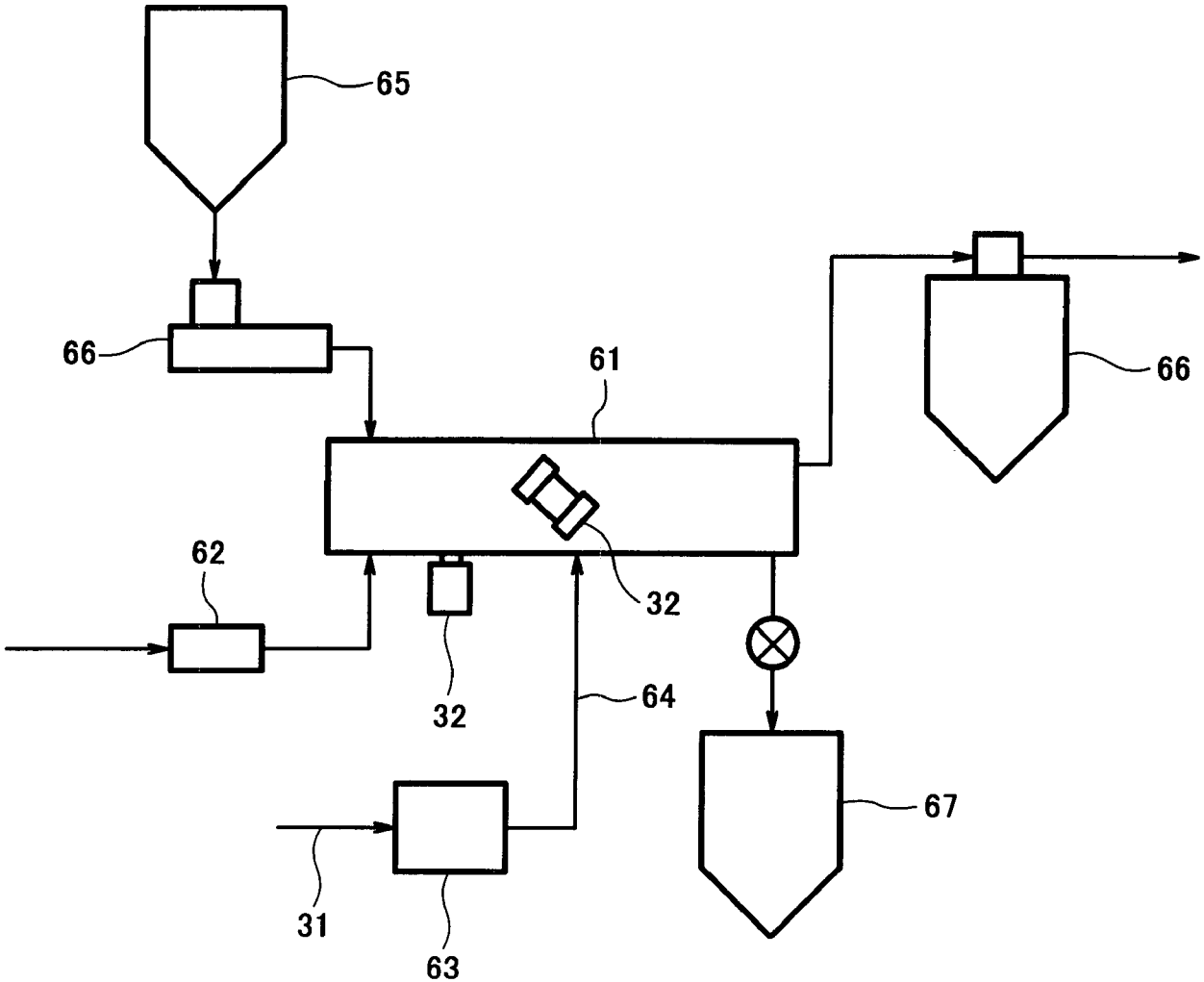
FIG. 14 is a block diagram schematically showing an electrostatic separation system according to another embodiment of the present invention.

FIG. 14 is a block diagram showing an example of an electrostatic separation system. The system comprises a d.c. voltage generator 62 for applying a d.c. voltage to an electrode of an electrostatic separation apparatus 61, a compressed-air line 63 for supplying dehumidified air as the dispersing air to the electrostatic separation apparatus 61, a dehumidifier 64 provided in the compressed-air line 64, a feeder 66 for feeding a material from a material hopper 65 to one end portion of the electrostatic separation apparatus 61, a dust collector 67 for suctioning the conductive particles from the electrostatic separation apparatus 61 by a blower (not shown) or the like and recovering the particles into conductive particle recovery hopper (not shown), and an insulating particle recovery hopper 68 for recovering the insulating particles from the electrostatic separation apparatus 61.

Figure 15:
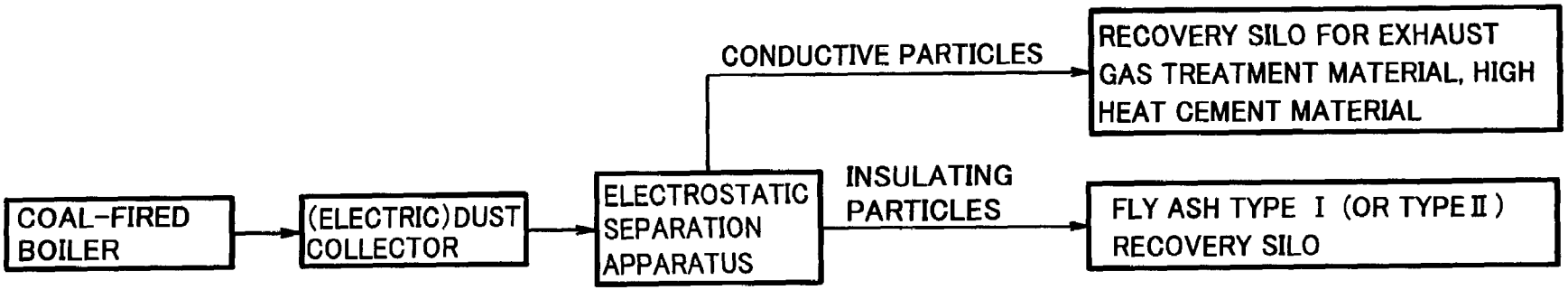
FIG. 15 is a block diagram showing an example of a process flow of a material using the electrostatic separation system of the present invention.
Figure 16:
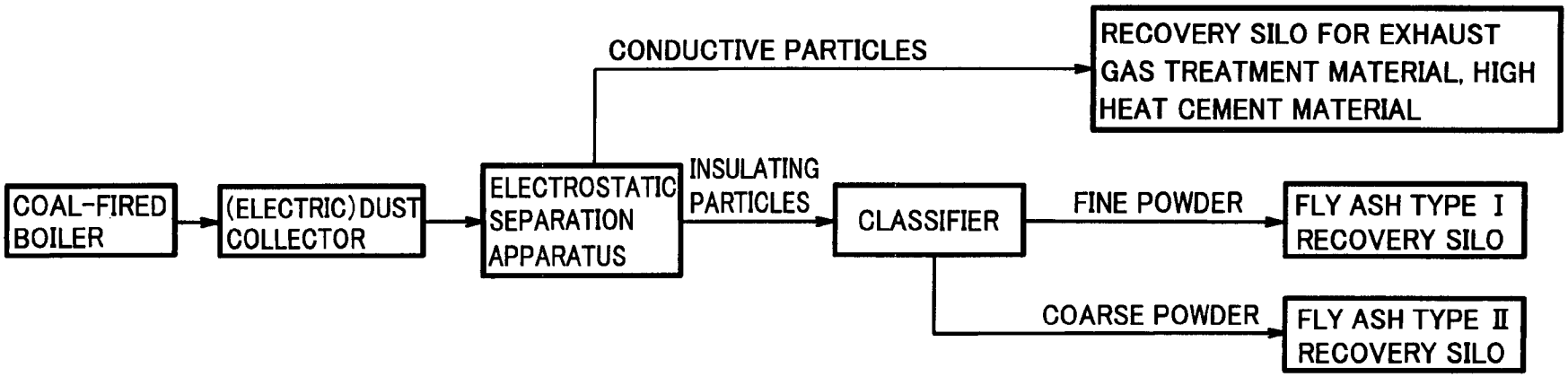
FIG. 16 is a block diagram showing another example of the process flow of the material using the electrostatic separation system of the present invention.

FIGS. 15 and 16 are block diagrams showing a system comprising an electrostatic separation apparatus according to a seventh embodiment of the present invention. In this system, the coal ash recovered by the dust collector using power or the like is delivered to a hopper (not shown), from where the coal ash is cut out and separated into the conductive particles and the insulating particles by any one of the electrostatic separation apparatuses, and the separated respective particles are recovered into a recovery silo. With sample coal ash containing unburned component with a content of approximately 4% or more, it is difficult to produce fly ash containing unburned component with a content of 3% or less that is specified as JIS A-6201 fly ash type I when treated only by a classifier. Even if they could be produced, its recovery rate is very low.

In the system in FIG. 15 using the above electrostatic separation apparatus, coal ash containing unburned component with a content of 3% or less that is specified as JIS A-6201 fly ash type I. It should be appreciated that when a specific surface area of the recovered coal ash does not meet 5000 according to the fly ash type I, it becomes possible to produce the coal ash meeting the fly ash type I at a high recovery rate by combining the electrostatic separation apparatus and the classifier as shown in FIG. 16. Specifically, in the system in FIG. 16, the classifier is provided in a path for recovering the insulating particles from the electrostatic separation apparatus in the system in FIG. 15 into the recovery silo. Thereby, finer particles, i.e., particles containing the insulating particles with high percentage, can be obtained.

Hereinafter, the present invention will be described in detail by means of experiments.

Experiment 1

The electrostatic separation was carried out under the following conditions using the apparatus configured as shown in FIG. 5. The dispersing air was supplied to a dispersing plate (layered sintered porous plate) as positive electrode installed on the bottom at a flow rate of 5 mm/sec, and the entire apparatus was subjected to vibration at an amplitude of 1.5 mm and at a frequency of 25 Hz, a d.c. power supply was connected to the negative electrode provided to be 20 mm distant from the bottom electrode and having meshes of 0.6 mm, a voltage was applied across the electrodes, and under an electric field strength of 0.5 kV/mm, the electrostatic separation was carried out. Under these conditions, using two kinds of coal ash (unburned component=conductive particle weight percentage: 4.2%, 2.3%) as the material, separation of the conductive particles (unburned component) and the insulating particles (ash) was conducted for 10 seconds. The result was that the insulating particles with the conductive particle weight percentage (unburned component weight percentage)=2.4% and 1.7% were separated and recovered.

Experiment 2

The electrostatic separation was carried out under the following conditions using the apparatus configured as shown in FIG. 6. Dehumidified dispersing air (dew point:−4° C.) was supplied to a dispersing plate (layered sintered porous plate) as positive electrode installed on the bottom surface at a flow rate of 10 mm/sec, and the entire apparatus was subjected to horizontal vibration in the direction of the insulating particle recovery portion at an amplitude of 1.5 mm and at a frequency of 25 Hz, and four electrodes having meshes of 1 mm and distance of 20 mm between the electrodes were multi-layered above the bottom positive electrode. Among the four electrodes plus the bottom positive electrode, first, third, and fifth electrodes from the bottom were set as positive electrodes (ground potential), minus potential was applied to the second and fourth electrodes, and under the electric field strength between the electrodes set to 0.65 kV/mm, the electrostatic separation was carried out. Under these conditions, using coal ash (conductive particle (unburned component) weight percentage=4.2%) as the material, separation of the conductive particles (unburned component) and the insulating particles (ash) was conducted for 60 seconds. The result was that the insulating particles with the conductive particle weight percentage (unburned component weight percentage)=1.5% and with 70% of feed amount was obtained in the separation zone.

Experiment 3

The electrostatic separation was carried out under the following conditions using the apparatus configured as shown in FIGS. 7, 8, and 9. Dehumidified dispersing air (dew point:−4° C.) was supplied to the dispersing plate (layered sintered porous plate) as positive electrode installed on the bottom surface at a flow rate of 10 mm/sec, and the entire apparatus was subjected to horizontal vibration in the direction of the insulating particle recovery portion at an amplitude of 1.5 mm and at a frequency of 25 Hz, and four electrodes having meshes of 1 mm and distance of 20 mm between the electrodes were multi-layered above the bottom positive electrode (+). The inclination angle of the electrode was 25°. Among the four electrodes plus the bottom positive electrode, first, third, and fifth electrodes were set as positive electrodes (ground potential), minus potential was applied to the second and fourth electrodes, and under the electric field strength between the electrodes set to 0.65 kV/mm, the electrostatic separation was carried out. As a preparation, a dispersing agent (calcium sterate) was added to coal ash (conductive particle (unburned component) weight percentage=4.2%) as the material, and the resulting coal ash was stirred in a stirring mixer. The material was fed to an upper end portion of the bottom dispersing plate at 1 kg/hr by at powdered material feeder, and separation was carried out under the above-mentioned condition. The powdered material was separated in the electrostatic separation zone while being dispersed by vibration of the bottom surface and action of the dispersing air, into the conductive particles (unburned component) and the insulating particles (ash) based on the above-mentioned principle. As a result of the experiment, powdered material with conductive particle (unburned component) weight percentage=1.2% and 75% of the feed amount was continuously obtained as the insulating particles.

Experiment 4

The electrostatic separation was carried out under the following conditions using the apparatus configured as shown in FIGS. 7, 8, and 9. Dehumidified air (dew point:−4° C.) as the dispersing air was supplied to the dispersing plate (layered sintered porous plate) as positive electrode, and the entire apparatus was subjected to horizontal vibration in the direction of the insulating powdered material recovery portion, and three electrodes including the bottom electrode were multi-layered. The electric field strength between the electrodes was set to 0.45 kV/mm and 0 kV/mm for one second every ten seconds. This is called pulsation. Under these conditions, using coal ash A (unburned component=conductive particle weight percentage=4.2%) as the material, the separation test was carried out.

The material was continuously fed to an upper end portion of the bottom dispersing plate and then was fed into the electrostatic separation zone while being dispersed by vibration of the bottom surface and action of the dispersing air. In the separation zone, the material was electrostatically separated into the insulating particles and the conductive particles. As a result, powdered material with conductive particle (unburned component) weight percentage=1.2% and 78% of the feed amount was continuously obtained as the insulating particles.

Experiment 5

An example of experiment using the apparatus in FIG. 9 is shown. In order to recover the conductive particles, gases equal in amount to the gases introduced from the bottom dispersing plate were suctioned. The other conditions were identical to those of the experiment 3. As a sample material, coal ash A (unburned component=conductive particle weight percentage=4.2%) was used in the same manner as described above.

In the separation zone, the coal ash A was electrostatically separated into the insulating particles and the conductive particles. As the insulating particles recovered by the insulating particle recovery portion, the powdered material containing the conductive particle (unburned component) weight percentage=1.1% was continuously obtained at a recovery rate of 70%. In the recovery portion of the conductive particles, the powdered material containing conductive particles with conductive particle (unburned component) weight percentage)=11% was recovered at a recovery rate of about 30%.

Experiment 6

Using the apparatus in FIG. 9, the amount of the recovered insulating particles was continuously metered by the load cell as shown in FIG. 12, and test was conducted while controlling the voltage being applied so that the recovery amount became equal to approximately 70% of the amount of fed material. When the amount of the recovered insulating particles was reduced, the voltage being applied was set low, while when the recovery amount was increased, the voltage being applied was set high. The other conditions were identical to those of the experiment 3.

Using the coal ash A (unburned component=conductive particle weight percentage=4.2%) as the material and under an average electric field strength of approximately 0.4 kV/mm in the separation zone, the insulating particles with the conductive particle (unburned component) weight percentage=1.4±0.08% in an error range of 75±2.8% of the feed amount were continuously obtained in the insulating particle recovery portion. On the other hand, using the coal ash B (unburned component =conductive particle weight percentage=5.0%) as the material and under an average electric field strength of approximately 0.6 kV/mm in the separation zone, the insulating particles with the conductive particle (unburned component) weight percentage=1.3±0.06% in an error range of 72±2.3% of the feed amount were continuously obtained in the insulating particle recovery portion.

In summary, proper applied voltage varies depending on the kind of coal ash. Specifically, the proper applied voltages for the coal ash A and the coal ash B are 0.4 kV/mm and 0.6 kV/mm, respectively. With the above-mentioned method, the recovery rate of the insulating particles was metered for different fed materials. As a result, a continuous operation with purity and recovery rate stabilized was accomplished.

Experiment 7

Using the apparatus in FIG. 9 and under the conditions identical to those of the experiment 6, the electrostatic separation was carried out. Sample materials were coal ash C (unburned component=conductive particle weight percentage=2.2%, total mercury content=0.11 mg/kg), and coal ash D (unburned component=conductive particle weight percentage=4.2%, total mercury amount=0.34 mg/kg). In the coal ash C, the insulating particles had total mercury content of 0.04 mg/kg and the conductive particles had total mercury content of 0.28 mg/kg. In the coal ash D, the insulating particles had total mercury content of 0.10 mg/kg and the conductive particles had (unburned component) weight percentage of 22.3% and total mercury content of 1.3 mg/kg. By removing the conductive particles, wastes were stabilized.

Experiment 8

The coal ash (unburned component content=1.2%, specific surface area=3600 (by a blaine permeability method) ) recovered in the Experiment 4 was classified by a forced vortex classifier. As a result, coal ash with unburned component content=1.1% and specific surface area=5200 (by blaine permeability method) satisfactorily meeting JIS A-6201 fly ash type I was obtained.

Contrast with Experiment 4

The electric field strength in the separation zone was set constant (0.45 kV/mm) without pulsation and the other conditions were set identical to those of the experiment 4. Under the condition, the electrostatic separation was carried out. As a result, the powdered material with conductive particle (unburned component) weight percentage=1.4% and 70% of the feed amount was recovered as the insulating particles. The result was that separating capability (purity and recovery rate) was lower than that of the experiment 4.

Contrast with Experiment 5

A cover was attached onto the entire separation zone and an opening portion, i.e., suction portion (recovery portion) was provided forward of the separation zone. In this state, the conductive particles ware recovered. Specifically, the same conditions as those in Experiment 5 were used except for the direction toward which the conductive particles were suctioned. In this case, with the powdered material containing the conductive particles (unburned component) weight percentage=3.0%, 40% of the insulating particles were recovered in the insulating particle recovery portion, and with the powdered material containing the conductive particles with unburned weight percentage=3.2%, 55% of the insulating particles were recovered. As a result, the separating capability was significantly lower than that of Experiment 5.

Contrast with Experiment 8

Coal ash A (unburned component=conductive particle weight percentage=4.2%, specific surface area=3000) were classified by the forced vortex classifier. Specifically, the material was directly classified without electrostatic separation. As a result, the unburned component of fine powdered material was 3.2% and the specific surface area (blaine value) was 5500, which did not meet JIS A-6201 fly ash type I.

Thus far, the coal ash have been described. In addition to this, it was verified that the conductive particles as impurities were removed and the insulating particles were recovered efficiently by adjusting process conditions, when using wastes such as casting sand dust and burned ash or other powdered materials.

The invention claimed is:

1. An electrostatic separation method of separating a powdered material containing a conductive component and an insulating component into the conductive component and the insulating component by an electrostatic force, comprising:

applying a voltage across a bottom electrode of a substantially flat-plate shape that is formed by a gas dispersing plate having air permeability and a mesh electrode of a substantially flat-plate shape, the mesh electrode being provided above the bottom electrode and having a number of openings;

generating a direct current electric field between one of the bottom electrode and the mesh electrode as a positive electrode and the other electrode as a negative electrode, to form a separation zone by an electrostatic force;

introducing a dispersing gas that is pre-dehumidified into the separation zone from underside of the gas dispersing plate;

feeding the material from one side of the separation zone to an upper end portion of the bottom electrode with the bottom electrode and the mesh electrode inclined, causing the conductive component in the material fed into the separation zone to move through the openings of the mesh electrode to be separated above the separation zone, and recovering remaining insulating particles from a lower end portion of the bottom electrode at the other side of the separation zone.

2. The electrostatic separation method according to claim 1, wherein a plurality of mesh electrodes are multi-layered as spaced from one another, and a voltage is applied across mesh electrodes to form the separation zone.

3. The electrostatic separation method according to claim 2, wherein the number of the mesh electrodes is varied.

4. The electrostatic separation method according to claim 1, wherein at least one of an inclination angle of the electrode and a length of the mesh electrode in an inclination direction is varied.

5. The electrostatic separation method according to claim 1, wherein a voltage being applied across the electrodes is varied.

6. The electrostatic separation method according to claim 1, wherein a voltage being applied across the electrodes is pulsated.

7. The electrostatic separation method according to claim 1, wherein the conductive component is recovered by outwardly suctioning a gas in a space above the separation zone together with the conductive component.

8. The electrostatic separation method according to claim 1, wherein a member having a number of suction holes is provided in a side portion of the space above the separation zone or in an upper portion of the space above the separation zone, and the gas in the space above the separation zone is outwardly suctioned together with the conductive component through the suction holes.

9. The electrostatic separation method according to claim 1, wherein amount of recovered insulating particles is metered, and according to a recovery rate of the recovered insulating particles, at least one of the applied voltage, amount of the supplied dispersing gas, amount of the suctioned gas for recovering the conductive particles, and amount of the fed powdered material is adjusted.

10. The electrostatic separation method according to claim 1, wherein amount of the conductive particles that pass through openings of the mesh electrode is metered, and according to variation in the amount of the conductive particles, at least one of the applied voltage, amount of the supplied dispersing gas, amount of the suctioned gas for recovering the conductive particles, and amount of the fed powdered material is adjusted.

11. The electrostatic separation method according to claim 1, wherein at least one of stirring, heating, and addition of dispersing agent is performed on the powdered material before being fed into the separation zone.

12. The electrostatic separation method according to claim 1, wherein when the fed powdered material contains unburned component, the unburned component is recovered together with the conductive particles.

13. An electrostatic separation method of separating a powdered material containing a conductive components and an insulating component into the conductive component and the insulating component by an electrostatic force, comprising:

applying a voltage across a bottom electrode of a substantially flat-plate shape that is formed by a gas dispersing plate having air permeability and a mesh electrode of a substantially flat-plate shape, the mesh electrode being provided above the bottom electrode and having a number of openings;

generating a direct current electric field between one of the bottom electrode and the mesh electrode as a positive electrode and the other electrode as a negative electrode, to form a separation zone by an electrostatic force;

introducing a dispersing gas into the separation zone from an underside of the gas dispersing plate;

applying vibration or impact to at least one of the bottom electrode and the mesh electrode;

feeding the material from one side of the separation zone to an upper end portion of the bottom electrode with the bottom electrode and the mesh electrode inclined, causing the conductive component in the material fed into the separation zone to move through the openings of the mesh electrode to be separated above the separation zone, and recovering remaining insulating particles from a lower end portion of the bottom electrode at another side of the separation zone.

14. The electrostatic separation method according to claim 13, wherein the dispersing gas is pre-dehumidified before being introduced.

15. The electrostatic separation method according to claim 13, wherein a plurality of mesh electrodes are multi-layered as spaced from one another, and a voltage is applied across mesh electrodes to form the separation zone.

16. The electrostatic separation method according to claim 15, wherein the number of the mesh electrodes is varied.

17. The electrostatic separation method according to claim 13, wherein at least one of an inclination angle of the electrode and a length of the mesh electrode in an inclination direction is varied.

18. The electrostatic separation method according to claim 13, wherein a voltage being applied across the electrodes is varied.

19. The electrostatic separation method according to claim 13, wherein a voltage being applied across the electrodes is pulsated.

20. The electrostatic separation method according to claim 13, wherein the conductive component is recovered by outwardly suctioning a gas in a space above the separation zone together with the conductive component.

21. The electrostatic separation method according to claim 13, wherein a member having a number of suction holes is provided in a side portion of the space above the separation zone or in an upper portion of the space above the separation zone, and the gas in the space above the separation zone is outwardly suctioned together with the conductive component through the suction holes.

22. The electrostatic separation method according to claim 13, wherein an amount of recovered insulating particles is metered, and according to a recovery rate of the recovered insulating particles, at least one of the applied voltage, amount of the supplied dispersing gas, amount of the suctioned gas for recovering the conductive particles, and amount of the fed powdered material is adjusted.

23. The electrostatic separation method according to claim 13, wherein an amount of the conductive particles that pass through openings of the mesh electrode is metered, and according to variation in the amount of the conductive particles, at least one of the applied voltage, amount of the supplied dispersing gas, amount of the suctioned gas for recovering the conductive particles, and amount of the fed powdered material is adjusted.

24. The electrostatic separation method according to claim 13, wherein at least one of stirring, heating and addition of a dispersing agent is performed on the powdered material before being fed into the separation zone.

25. The electrostatic separation method according to claim 13, wherein when the fed powdered material contains an unburned component, the unburned component is recovered together with the conductive particles.

26. An electrostatic separation apparatus for separating a powdered material containing a conductive component and an insulating component into the conductive component and the insulating component by an electrostatic force, comprising:

a substantially flat-plate shaped bottom electrode that is provided on lower side and is formed by a gas dispersing plate having air permeability;

a mesh electrode provided above the bottom electrode and spaced a predetermined distance apart from the bottom electrode and having a number of openings to allow particles to pass therethrough; and a material feed portion provided at one end portion between the bottom electrode and the mesh electrode;

a recovery portion of the insulating component provided at another end portion between the bottom electrode and the mesh electrode;

a direct current power supply connected to at least one of the mesh electrode and the bottom electrode;

an air box provided under the gas dispersing plate for introducing a dispersing gas; and a vibration applying means or an impact applying means mounted to at least one of the bottom electrode and the mesh electrode, for applying vibration or impact to the electrodes, wherein a voltage is applied across the bottom electrode and the mesh electrode to form a separation zone between the electrodes, a suction device connected to a space above the separation zone; and wherein a gas is ejected from the air box through the gas dispersing plate.

27. The electrostatic separation apparatus according to claim 26, further comprising a plurality of mesh electrodes layered as spaced a predetermined distance apart from one another, wherein a direct current power supply is connected to at least one of the mesh electrodes, and a separation zone in a high electric field atmosphere is formed between the mesh electrodes.

28. The electrostatic separation apparatus according to claim 26, wherein the bottom electrode and the mesh electrode are provided as being inclined, a material feed portion is provided at an upper end portion of the bottom electrode, and a recovery portion of the insulating component is connected to a lower end portion of the bottom electrode, the conductive component is adapted to move through openings of the mesh electrode and to be recovered above the separation zone, and the insulating component is adapted to be recovered at the lower end portion of the bottom electrode.

29. The electrostatic separation apparatus according to claim 26, further comprising a direct current high voltage generator capable of varying a voltage being applied across the electrodes.

30. The electrostatic separation apparatus according to claim 26, further comprising a direct current high voltage generator capable of pulsating the voltage being applied across the electrodes.

31. The electrostatic separation apparatus according to claim 26, further comprising a pipe or a plate provided in a side portion of a space above the separation zone or in an upper portion of the space above the separation zone, the pipe or the plate having a number of suction holes to allow particles to pass therethrough, wherein air in the space above the separation zone is suctioned through the suction holes.

32. The electrostatic separation apparatus according to claim 26, further comprising at least one of a meter for continuously metering amount of the recovered insulating particles and a meter for metering amount of the conductive particles that pass through the openings of the mesh electrode.

33. The electrostatic separation apparatus according to claim 26, further comprising a classifier for classifying the particles.

* * * * *

UNITED STATES PATENT AND TRADEMARK OFFICE

CERTIFICATE OF CORRECTION

PATENT NO. : 7,119,298 B2
APPLICATION NO. : 10/344683
DATED : October 10, 2006
INVENTOR(S) : Eiji Yoshiyama et al.

It is certified that error appears in the above-identified patent and that said Letters Patent is hereby corrected as shown below:

On the Title Page:

At Item (74), "Marshall" should be -- Marshall, --.

In the Claims:

At Column 17, line 34, "components" should be -- component --.

Signed and Sealed this
Twelfth Day of March, 2013

Teresa Stanek Rea
*Acting Director of the United States Patent and Trademark Office*